US006857145B1

(12) United States Patent
Sikes

(10) Patent No.: US 6,857,145 B1
(45) Date of Patent: Feb. 22, 2005

(54) ADJUSTABLE LOUNGE FOR PREGNANCY SUPPORT AND METHOD

(76) Inventor: Steve C. Sikes, P.O. Box 1013, Hinesville, GA (US) 31313

( * ) Notice: Subject to any disclaimer, the term of this patent is extended or adjusted under 35 U.S.C. 154(b) by 0 days.

(21) Appl. No.: 10/633,767

(22) Filed: Aug. 4, 2003

(51) Int. Cl.[7] ..... A47C 17/66
(52) U.S. Cl. ..... 5/110; 5/114; 5/631; 5/930
(58) Field of Search ..... 5/110, 111, 112, 5/114, 116, 117, 631, 735, 930

(56) References Cited

U.S. PATENT DOCUMENTS

| | | | | | |
|---|---|---|---|---|---|
| 2,089,854 | A | * | 8/1937 | Pellegrini | 5/735 |
| 3,378,862 | A | | 4/1968 | Skinner | 5/345 |
| 3,464,069 | A | * | 9/1969 | Bien | 5/110 |
| 3,988,793 | A | * | 11/1976 | Abitbol | 601/11 |
| 4,051,566 | A | * | 10/1977 | Esquivel | 5/722 |
| 4,054,960 | A | * | 10/1977 | Pettit et al. | 5/631 |
| 4,382,306 | A | | 5/1983 | Lickert | 5/465 |
| 4,508,384 | A | * | 4/1985 | Castelot et al. | 297/284.1 |
| 4,737,999 | A | * | 4/1988 | Halverson | 5/710 |
| 4,819,287 | A | * | 4/1989 | Halverson | 5/710 |
| 4,921,301 | A | * | 5/1990 | Haynes | 297/118 |
| 4,973,034 | A | * | 11/1990 | Michele | 5/617 |
| 5,029,349 | A | * | 7/1991 | Hamilton | 5/111 |
| 5,185,897 | A | * | 2/1993 | Van Laanen | 5/710 |
| D335,999 | S | * | 6/1993 | Van Driessche | D6/604 |
| 5,237,712 | A | * | 8/1993 | Ramsay | 5/710 |
| D341,725 | S | | 11/1993 | Piper | D6/361 |
| 5,369,824 | A | | 12/1994 | Powell | 5/465 |
| D355,983 | S | * | 3/1995 | Mutch | D6/361 |
| D357,538 | S | * | 4/1995 | Sockwell et al. | D24/183 |
| 5,412,824 | A | * | 5/1995 | Emerson et al. | 5/632 |
| 5,438,715 | A | * | 8/1995 | Jackman | 5/110 |
| 5,679,040 | A | * | 10/1997 | Bianchi-Holm | 441/129 |
| 5,819,348 | A | * | 10/1998 | Ryan | 5/735 |
| 5,890,246 | A | * | 4/1999 | Davis | 5/735 |
| 6,295,668 | B1 | * | 10/2001 | Nation | 5/110 |
| 6,568,015 | B1 | * | 5/2003 | Allen | 5/735 |
| 6,588,034 | B2 | * | 7/2003 | Nation | 5/110 |
| 2002/0016993 | A1 | * | 2/2002 | Nation | 5/110 |
| 2002/0095723 | A1 | * | 7/2002 | Nation | 5/110 |

FOREIGN PATENT DOCUMENTS

| | | | | |
|---|---|---|---|---|
| DE | 2826074 A1 | * | 12/1979 | 5/631 |
| FR | 2361842 A1 | * | 3/1978 | 5/114 |
| FR | 2397804 A2 | * | 2/1979 | 5/114 |

* cited by examiner

*Primary Examiner*—Robert G. Santos
(74) *Attorney, Agent, or Firm*—Baker, Donelson, Bearman, Caldwell & Berkowitz, PC

(57) ABSTRACT

An adjustable cot for supporting a pregnant woman, in which an elongate frame (14) includes leg members (24) to support the frame spaced-apart from a surface. A fabric sheet (16) attaches to the frame (12). A central portion of the fabric sheet defines a receiving recess (12) extending in a first direction from a plane defined by the frame. The receiving recess (12) adjusts from a first depth to a second depth by drawcards (34) in channels 32 in the receiving recess. The volume of the receiving recess is selectively changed to accommodate a protruding portion of a pregnant woman lying on the fabric sheet.

10 Claims, 2 Drawing Sheets

ADJUSTABLE LOUNGE FOR PREGNANCY SUPPORT AND METHOD

TECHNICAL FIELD

The present invention relates to chaise lounges. More particularly, the present invention relates to a chaise lounge having an adjustable recess selectively sized for supporting a pregnant woman when lying on her stomach.

BACKGROUND OF THE INVENTION

Pregnancies are often life experiences of significant changes, increased joy, and growth both physical and conceptual. The expectant arrival brings the promise of a new individual and a sense of good. The pregnant woman experiences physical changes in her body as the child matures and grows in the womb. In later stages of pregnancy particularly, the physical changes of the mother makes sitting and lying down awkward. The protrudant abdomen of the pregnant woman often needs additional support when lying or sitting. Pillows are typically useful for providing such support.

Pillows however are difficult to position in order to allow the woman to sleep facing down. It has been suggested in text that sleep or rest of the pregnant woman in a prone face down position may be beneficial. To address this, mattresses having a cavity to accommodate the protruding abdomen are known. For example, a maternity mattress provides a foam mattress with a recessed cavity. A stretchable panel spans over the cavity. A removable plug fills the cavity during periods when the cavity is not required for use. Also, chaise lounges configured for pregnant woman are known. These provide an opening with a panel extending below a seating portion. The panel supports the protrudant abdomen.

These mattresses and chaise lounges however have drawbacks. The supporting surface that defines the cavity is inadequately configured as the needs for the cavity expand over the course of the pregnancy. Further, these specialty mattresses and the like are significant investments for a product which may be used over a relatively short period.

It is thus seen that there is a need in the art for a simplified lounge chaise or cot that provides a recess selectively adjustable for supporting a pregnant woman when lying on her stomach. It is to such that the present invention is directed.

BRIEF SUMMARY OF THE PRESENT INVENTION

The present invention meets the need in the art by providing a simplified lounge cot having a recess selectively adjustable for supporting a pregnant woman when lying on her stomach, in which an elongate frame includes leg members to support the frame spaced-apart from a surface. A fabric sheet attaches to the frame. A central portion of the fabric sheet defines a receiving recess extending in a first direction from a plane defined by the frame. The central portion is adjustable in effective surface area and depth, whereby the receivable volume of the central portion receiving recess is selectively changed to accommodate a protruding abdomen of a pregnant woman lying on the fabric sheet.

In another aspect, the present invention provides a method for supporting a pregnancy on a cot, comprising the steps of:

(a) providing a fabric sheet with a portion that defines a receiving recess extending in a first direction from a plane defined by the frame, the fabric sheet supported by an elongate frame having leg members attached to the frame to support the frame spaced-apart from a surface; and (b) adjusting the portion with the receiving recess from a first size to a second size, whereby the receivable volume of the receiving recess is selectively changed to accommodate a protruding abdomen of a pregnant woman lying on the fabric sheet.

Objects, features, and advantages of the present invention will become apparent from a reading of the following detailed description of the invention and claims in view of the appended drawings.

DETAILED DESCRIPTION

Figure 1:
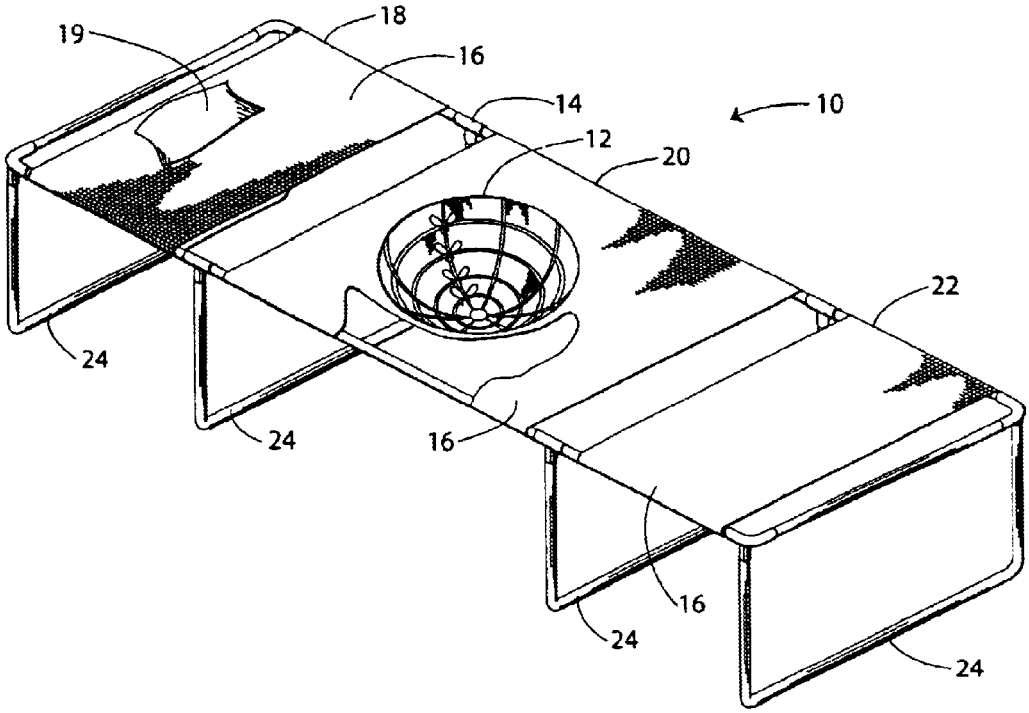
FIG. 1 illustrates in perspective view a cot with a portion defining a selectively adjustable recess according to the present invention for supporting a pregnant woman lying on her stomach.

Referring now in more detail to the drawings, in which like numerals indicate like parts throughout the several views, FIG. 1 illustrates in perspective view a chaise lounge or cot 10 with a portion defining a selectively adjustable recess 12 according to the present invention for supporting a pregnant woman lying on her stomach. The cot 10 includes an elongate frame generally 14 to which a fabric sheet 16 attaches. The illustrated embodiment of the cot 10 defines three sections 18, 20, and 22 for supporting an upper portion of a person using the cot, for supporting a mid-portion of the person, and for supporting a lower portion, or legs, of the person lying on the cot. Each section includes a separate one of the sheets 16. In an alternate embodiment, the sheet 16 is co-extensive over the frame 4. The section 18 includes a pillow portion 19 for supporting a person's head.

The section 20 includes the receiving recess 12 that extends in a first direction from a plane defined by the frame 14. The portion that defines the receiving recess 12 adjusts selectively in effective surface area and depth, so that a receivable volume of the central portion is selectively changed to accommodate a stomach or abdomen of a pregnant woman lying on the fabric sheet, as discussed below. Leg members 24 attach to the frame 14 to support the cot 10 in an elevated position relative to the ground or other surface on which the cot sits.

Figure 2:
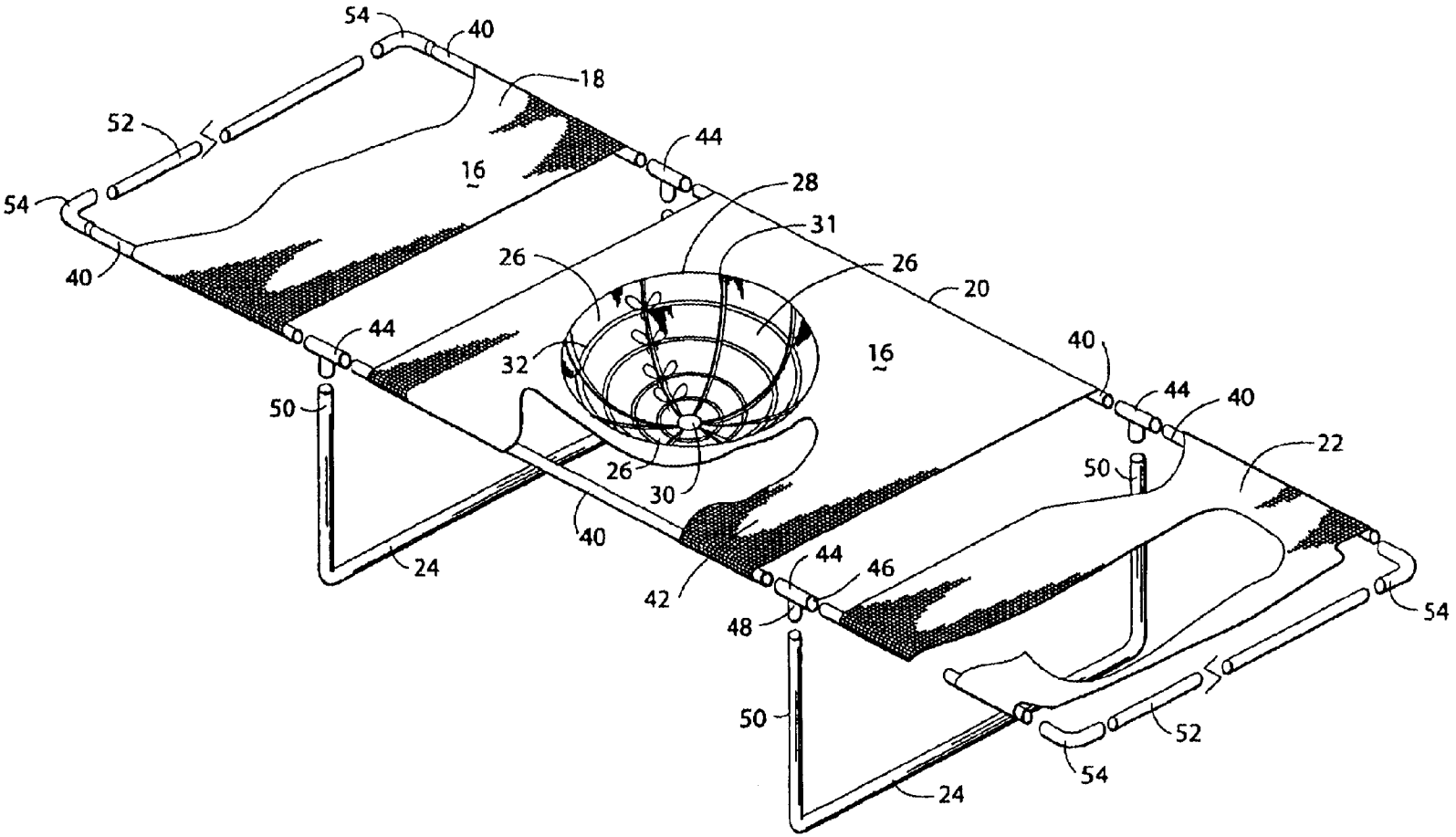
FIG. 2 illustrates in perspective cut-away view details of a frame and the adjustable recess for the cot illustrated in FIG. 1.

FIG. 2 illustrates in perspective cut-away view details of the frame 14 and the receiving recess 12 in the fabric sheet 16 of the mid-section 20 for the cot 10. A plurality of spaced-apart members 26 define the receiving recess 24. Each member 26 in the illustrated embodiment is a wedge-shaped sheet and tapers from an outer edge 28 to an inner edge 30. The outer edge 28 attaches to the sheet 16. The inner edge 30 attaches to inner edges 30 of adjacent members 26. The members 26 define gaps 31 and collectively define a bowl-shaped recess or in plan view a circular opening.

Figure 3:
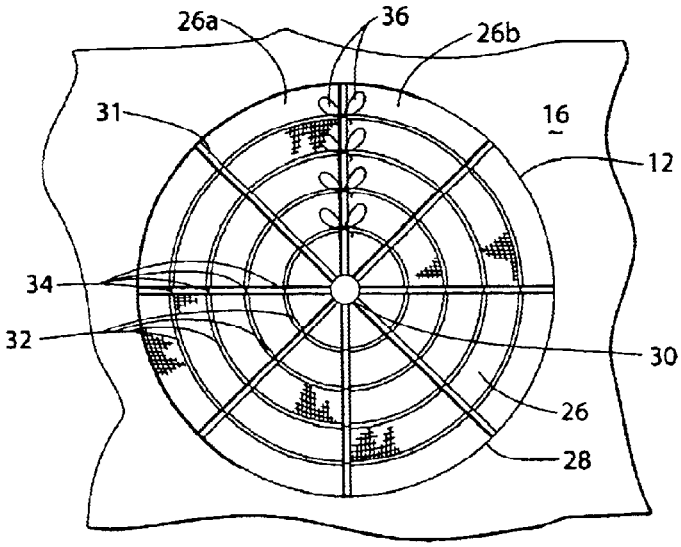
FIG. 3 illustrates in plan view details of the adjustable recess for the cot illustrated in FIG. 1.

FIG. 3 illustrates in plan view details of the adjustable receiving recess 12 for the cot 10. Each member 26 includes a plurality of spaced-apart channels 32. The channels 32 are open-ended passageways that receive a drawcord 34. Each drawcord 34 extends through aligned respective channels 32 in the arcuate-spaced adjacent members 26. Opposing distal end portions 36 of the drawcords 34 extend outward in one of the gaps 31 outwardly of opposing openings in adjacent ones of the members 26*a*, 26*b*. The distal portions 34 extend through the gap 31 outwardly of the defined receiving recess 12. The drawcords 34 are each of a length sufficient to leave at least several inches of the distal end portions 36 extending outwardly, for a purpose discussed below.

The channels 32 are defined by sewing a seam that joins portions of the member 26 to form a tubular passageway. The drawcords 34 are laid on the member 26, of which portions are overlapped over the drawcord prior to the sewing step. In another method of assembly, the drawcord in positioned after forming the channel 32. A flexible wire with a hook is engaged to the drawcord. The wire feeds through the channel to place the drawcord within the channel.

In an alternate embodiment, each member 26 comprises overlapped sheets. Spaced-apart seams are made by sewing the sheets together in order to define the channels 32 for receiving the drawcords 34.

In the illustrated embodiment, the central portion defining the receiving recess 12 is made of eight individual panels or members 26.

With continuing reference to FIG. 2, the frame 14 assembles with spaced-apart tubes or side members 40. The fabric sheet 16 defines opposing sleeves 42. The sleeves 42 receive a respective one of the side members 40. A T-connector 44 includes a frame connector 46 and a leg connector 48. The frame connector 46 receives a distal end of the side member 40. The leg connector 48 receives a leg portion 50 of the member 24. In the illustrated embodiment, the leg member 24 is a U-shaped tubular member that supports the cot 10 on opposing sides by connecting to the opposing T-connectors 44. A transverse member 52 connects with L-shaped angle connectors 54 to the distal ends of the side members 40 in the opposing sections 18 and 22.

After assembly, the cot 10 is available for use by a pregnant woman. The receiving recess 12 is adjusted. This is accomplished by pulling the distal ends 36 of the drawcords 34 outwardly of the openings though the gap 31 between adjacent members 26*a*, 26*b*. This draws the members 26 together and bunches portions of the members. This thereby narrows or reduces the effective surface area and depth of the central portion. This accomplishes a change in the effective volume of the receiving recess 12. The drawcords 34 are then tied together such as in a bow to accommodate releasing engagement. Each of the drawstrings 34 is pulled in order to cinch a portion of the receiving recess to a selected size. The result is a change in the volume that can be accommodated by the receiving recess 12, and thus selectively accommodate the changing expansion of the pregnant woman's protruding abdomen. The volume can similarly be increased by untying or releasing the drawcords 34 and pulling apart opposing portions of the members 26. The distal ends 36 are then re-secured to hold the selected position for the central portion that defines the receiving recess 12.

It is to be appreciated that the drawcords 34 may have spring biased latching buttons to hold or release the drawcords, to facilitate the selective change in the volume of the receiving recess 12, rather than tying bows.

It is to be appreciated that the receiving recess 12 of the present invention is gainfully used in other chaise lounge chairs. In an alternate embodiment, the leg members 24 conventionally pivotally connect to the frame 14 to facilitate handling, storage, and transportation of the cot 10. In addition, the fabric members 16 in an alternate embodiment comprise a plurality of spaced-apart strips attached conventionally to the side members 40 at longitudinally spaced distal ends. The mid-section 20 includes a wider strip having the receiving recess 12.

The present invention accordingly provides the adjustable cot having the receiving recess that selectively adjusts for pregnancy-support for a woman lying on her stomach on the cot. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. An adjustable cot for supporting a pregnant woman, comprising:

an elongate frame;

leg members attached to the elongate frame to support the frame spaced-apart from a surface;

a sheet attached to the frame; and the sheet having a central portion defining a receiving recess extending in a first direction from a plane defined by the frame; and the central portion comprising at least one tubular passageway therein with opposing openings thereto and an elongate cord extending through the at least passageway with opposing distal ends extending outwardly of the openings, whereby the ends of the cord, being nulled or relaxed, changes the portion of the cord within the at least one passageway whereby the central portion is adjustable in effective surface area and depth, whereby the receiving recess is selectively changed to accommodate a protruding abdomen of a pregnant woman lying on the sheet.

2. The adjustable cot as recited in claim 1, wherein the panels are wedge-shaped sheet members.

3. The adjustable cot as recited in claim 1, wherein the sheet is a fabric material.

4. An adjustable cot for supporting a pregnant woman, comprising:

an elongate frame;

a plurality of leg members attached to the elongate frame and movable from a first position against respective portions of the frame to a second position extending outwardly from the frame to support the frame spaced-apart from a surface;

a sheet attached to the frame and having a central portion of the sheet defining a receiving recess extending in a first direction from a plane defined by the frame, the central portion defined by a plurality of panels each attached at a respective first end and defining a plurality of spaced-apart passageways;

a plurality of cords, one of which is received in a respective one of the passageways with opposing distal ends of the cords extending outwardly in a gap between two of the adjacent panels, whereby the cords, being cinched or relaxed relative to the passageways, adjust the volume of the receiving recess to accommodate a protruding abdomen of a pregnant woman lying on the fabric sheet.

5. The adjustable cot as recited in claim 4, wherein the panels are wedge-shaped sheet members.

6. The adjustable cot as recited in claim 4, wherein the sheet is a fabric.

7. A method of selectively supporting a pregnant woman lying on a cot, comprising the steps of:

(a) providing a fabric sheet with a portion that defines a receiving recess extending in a first direction from a plane defined by the frame, the fabric sheet supported by an elongate frame having leg members attached to the frame to support the frame spaced-apart from a surface; and (b) adjusting the portion with the receiving recess from a first size to a second size by moving drawcords through a channel formed in the receiving recess in order to adjust the surface area and thereby chance the volume accommodated by the receiving recess, whereby the receivable volume of the receiving recess is selectively changed to accommodate a protruding abdomen of a pregnant woman lying on the fabric sheet.

8. An adjustable cot for supporting a pregnant woman, comprising:

an elongate frame;

leg members attached to the elongate frame to support the frame spaced-apart from a surface;

a sheet attached to the frame;

the sheet having a central portion defining a receiving recess extending in a first direction from a plane defined by the frame; and the central portion comprising a plurality of panels attached at an outer edge to the sheet and each panel defining at least one passageway that aligns with the at least one passageway of an adjacent panel and a cord slidingly received within the at least one passageways in sequence with opposing distal ends of the cord extending outwardly at a gap between two adjacent panels, whereby the ends of the cord, being pulled or relaxed, changes the portion of the cord within the at least one passageway to effect a change in the effective surface area and depth of the central portion, whereby the receiving recess is selectively changed to accommodate a protruding abdomen of a pregnant woman lying on the sheet.

9. The adjustable cot as recited in claim 8, wherein the sheet is fabric.

10. The adjustable cot as recited in claim 8, wherein the panels are wedge-shaped.

* * * * *

UNITED STATES PATENT AND TRADEMARK OFFICE

CERTIFICATE OF CORRECTION

PATENT NO. : 6,857,145 B2
DATED : February 22, 2005
INVENTOR(S) : Steve C. Sikes It is certified that error appears in the above-identified patent and that said Letters Patent is hereby corrected as shown below:

Column 4,
Line 33, please change "nulled" to -- pulled --.

Column 5,
Line 14, please change "chance" to -- change --

Signed and Sealed this

Twenty-fourth Day of May, 2005

JON W. DUDAS
*Director of the United States Patent and Trademark Office*